US005927138A

United States Patent [19]

Richardson

[11] Patent Number: 5,927,138

[45] Date of Patent: Jul. 27, 1999

[54] METHOD OF FORMING A STRUCTURAL MEMBER FROM TUBULAR MATERIAL

[75] Inventor: Downie S. Richardson, Long Beach, Calif.

[73] Assignee: McDonnell Douglas Corporation, Huntington Beach, Calif.

[21] Appl. No.: 08/955,042

[22] Filed: Oct. 21, 1997

[51] Int. Cl.[6] ..... B21D 41/00

[52] U.S. Cl. ..... 72/370.1; 29/897.3

[58] Field of Search ..... 72/367.1, 370.04, 72/370.1, 370.13, FOR 100, FOR 101; 29/897.3, 897.31, 897.35; 403/237, 354

[56] References Cited

U.S. PATENT DOCUMENTS

| | | | |
|---|---|---|---|
| 1,420,669 | 6/1922 | Schutte . | |
| 2,098,752 | 11/1937 | Miller | 403/237 |
| 3,818,746 | 6/1974 | Fujita | 72/356 |
| 4,014,201 | 3/1977 | Troutner et al. | 72/370.1 |
| 4,088,001 | 5/1978 | Ishikawa et al. | 72/370 |
| 4,621,421 | 11/1986 | O'Loughlin | 29/874 |
| 5,333,485 | 8/1994 | Ublacker | 72/367 |

FOREIGN PATENT DOCUMENTS

| | | | |
|---|---|---|---|
| 40 22 692 | 1/1992 | Germany | 72/FOR 100 |

*Primary Examiner*—Lowell A. Larson
*Attorney, Agent, or Firm*—Senniger, Powers, Leavitt & Roedel

[57] ABSTRACT

A method of forming a structural member from a tubular member having a hollow interior. The method includes cutting a pair of slots in the tubular member. The slots extend from a free end of the tubular member and generally longitudinally with respect thereto. The slots are located generally opposite one another. The method further includes inserting a platen edgewise into the slots so that the platen extends across the hollow interior of the tubular member from one slot to the other slot. The platen has a thickness less than the width of the slots. opposing end portions of the tubular member are radially compressed against opposite faces of the platen to form two generally parallel plates projecting endwise from the tubular member. The plates are spaced apart a distance generally equal to the thickness of the platen.

16 Claims, 2 Drawing Sheets

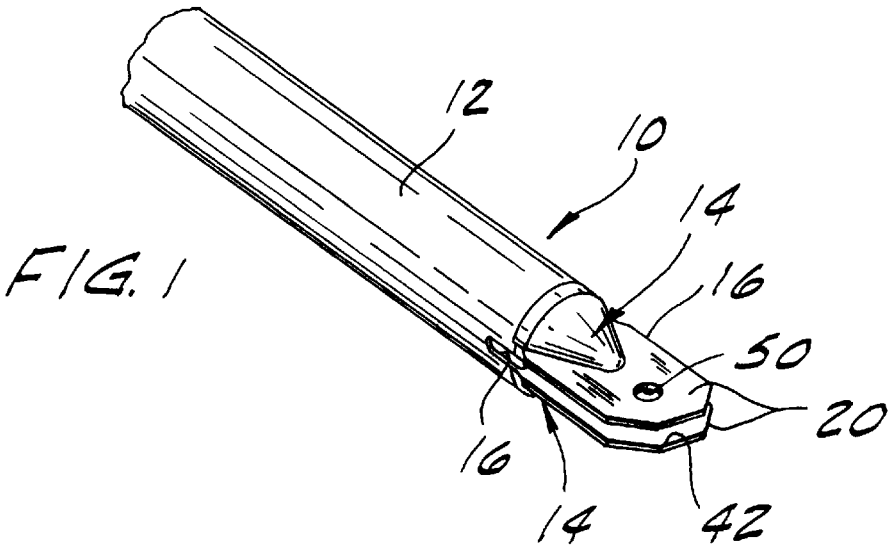
FIG. 1
FIG. 2
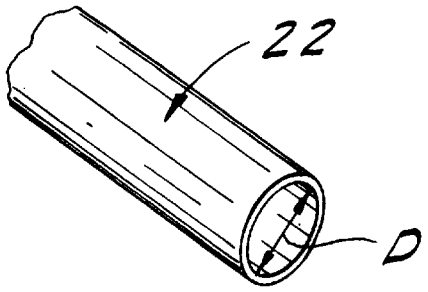
FIG. 3
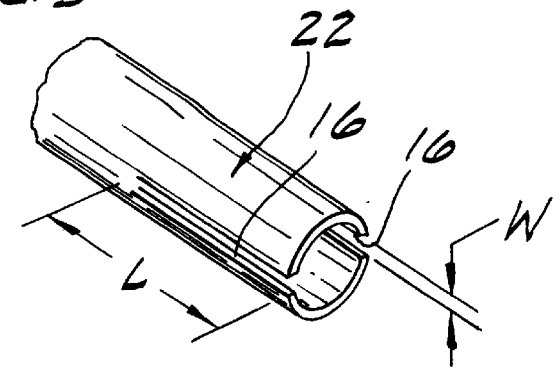

METHOD OF FORMING A STRUCTURAL MEMBER FROM TUBULAR MATERIAL

BACKGROUND OF THE INVENTION

This invention relates to structural members and, more particularly, to a one-piece strut formed from tubular material.

Structural members such as struts are commonly used for connecting structural components and transmitting load from one component to the other. Struts are generally formed from tubular material and have flattened ends for connecting the struts to other linkages or surrounding structure. In applications such as aircraft structure, struts must be capable of withstanding high loads without failure.

Conventional struts are typically formed by flattening the ends of a tubular member. During the process the ends of the member undergo significant stress, which reduces the strength of the strut and increases the likelihood of fatigue failure. The flattened high stressed areas are locations where cracks may initiate and lead to catastrophic failure of the strut under high load conditions.

Another type of strut comprises a tubular member and separate end fittings attached to the tubular member. The end fittings are typically expensive to manufacture and increase manufacturing time of the strut since they have to be connected to ends of the tubular member. The connections between the end fittings and the tubular member also create possible failure points in the strut.

SUMMARY OF THE INVENTION

The present invention overcomes the deficiencies of the prior art by providing a strut which is integrally formed from a tubular member and can be used in high stress applications. A pair of longitudinal slots are cut in the ends of the tubular member at locations where stresses are normally created during the aforementioned conventional flattening process. These slots eliminate high stress areas which are normally present with tubular struts having flattened ends. The strut is integrally formed as one-piece, thus eliminating the need for expensive end fittings which may reduce the reliability of the strut. A method of manufacturing the strut of this invention provides a simple, inexpensive and repeatable method for forming the strut. The strut of the invention overcomes the deficiencies of prior art struts by providing a strut which can carry high loads, is economical to manufacture, lightweight, and reliable.

A method of the present invention involves forming a structural member from a tubular member having a hollow interior. The method generally includes cutting a pair of slots in the tubular member extending from a free end of the tubular member and generally longitudinally with respect thereto. The slots are located generally opposite one another and each has a length and a width. The method further includes inserting a platen edgewise into the slots so that the platen extends across the hollow interior of the tubular member from one slot to the other slot. The platen has a thickness less than the width of the slots. Opposing end portions of the tubular member are radially compressed against opposite faces of the platen to form two generally parallel plates projecting endwise from the tubular member. The plates are spaced apart a distance generally equal to the thickness of the platen.

A strut of the present invention is manufactured from a tubular member having a hollow interior. The strut generally comprises a tubular portion with opposite ends and an inside dimension across the hollow interior. A pair of opposing end portions project endwise from an end of the tubular portion of the strut. The opposing end portions are integral with the tubular portion and flattened to form a pair of generally parallel plates spaced apart a distance less than the inside dimension of the tubular portion of the strut. The end portions of the strut are capable of carrying loads transmitted therethrough from the tubular portion of the strut. A pair of slots, defined in part by adjacent sides of the two plates extend into,the tubular portion of the strut at locations generally opposite one another.

Other objects and features will be in part apparent and in part pointed out hereinafter.

BRIEF DESCRIPTION OF THE DRAWINGS

FIG. 1. is a partial perspective view of a strut of the present invention;

FIG. 2 shows a tubular member from which the strut of FIG. 1 is formed;

FIG. 3 shows the tubular member of FIG. 2 with a pair of slots cut therein;

Corresponding reference characters indicate corresponding parts throughout the several views of the drawings.

DETAILED DESCRIPTION OF THE INVENTION

Figure 4:
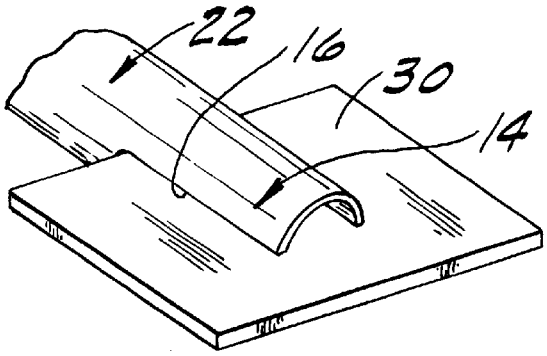
FIG. 4 shows the tubular member of FIG. 3 with a platen inserted in the slots of the tubular member for forming the strut.

Referring now to the drawings, and first to FIG. 1, a structural member, or strut, of the present invention is generally indicated at 10. The strut 10 is used, for example, as a load carrying member in connecting structural components on aircraft, spacecraft and other structures. A plurality of struts 10 may be used in a truss formation, for example. The struts 10 may also be used as connecting linkages in aircraft landing gear, rotor control linkages for helicopters, control rods for flight control actuators, and many other applications.

The strut 10 comprises a tubular portion 12 with opposite ends, and an inside dimension D across a hollow interior thereof (FIGS. 1 and 2). A pair of opposing end portions, generally indicated at 14, project endwise from an end of the tubular portion 12 of the strut 10. The opposing end portions 14 are integral with the tubular portion 12 and are flattened to form a pair of generally parallel plates 20 spaced apart a distance less than the inside dimension D of the tubular portion of the strut 10. A pair of slots 16 extend from a free end of the strut 10 and are defined in part by adjacent sides of the two plates 20. The slots 16 extend into the tubular portion 12 of the strut 10 at locations generally opposite one another. The slots 16 are located along a central longitudinal plane of the tubular portion about which the end portions 14 are compressed during formation of the strut in order to prevent the formation of stress concentrating creases in the strut 10. The end portions 14 are capable of carrying loads transmitted therethrough from the tubular portion 12 of the strut 10.

The strut 10 is formed from a tubular member, generally indicated at 22, having a hollow interior. The tubular member 22 is cut from a longer length of generally cylindrical hollow metal tubing. The tubing may have a diameter of 1.35 inches (3.43 cm), for example, and is preferably formed from aluminum, titanium or steel. Different diameter tubing and cross-sectional shapes other than cylindrical may also be used as well as other materials having sufficient load carrying characteristics. The length of the tubular member 22 is selected for the specific application and may be approximately 28.0 to 32.3 inches (71.1 to 82.0 cm), for example. The dimensions of the tubular member 22 are selected for the load carrying requirements of the specific application. The dimensions given herein are provided only as an example of one embodiment of the strut 10.

In order to form the strut 10, the pair of slots 16 are first cut in the tubular member 22 by milling or any other suitable method (FIG. 3). The slots 16 extend from the free end of the tubular member 22 and generally longitudinally with respect thereto. The slots 16 are located generally opposite one another and are preferably located diametrically opposite one another in the central longitudinal plane of the tubular member 22. Each slot 16 has a length L, a width W and a radius R formed in the tubular member 22 at a closed end of the slot 16 to create a concave curvature. The length L of the slot 16 may be 2.62 inches (6.65 cm) and the width W of the slot may be 0.188 inches (0.478 cm), for example.

A platen 30 is inserted edgewise into the slots 16 so that the platen extends across the hollow interior of the tubular member 22 from one slot 16 to the other slot (FIG. 4). The platen 30 is preferably a planar piece of sheet metal or other suitable material having a thickness less than the width W of the slots 16 (FIGS. 3 and 4). For example, a platen 30 used with the strut 10 described above may have a thickness of approximately 0.188 inches (0.478 cm). The platen 30 may have configurations other than shown without departing from the scope of this invention.

Figure 5:
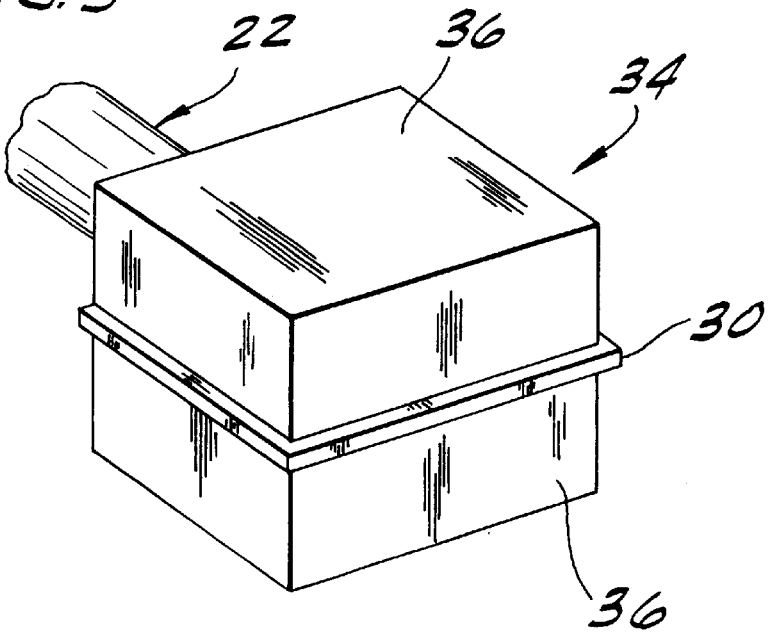
FIG. 5 shows the tubular member and platen of FIG. 4 inserted into a die used to compress opposing end portions of the member to form the strut.
Figure 6:
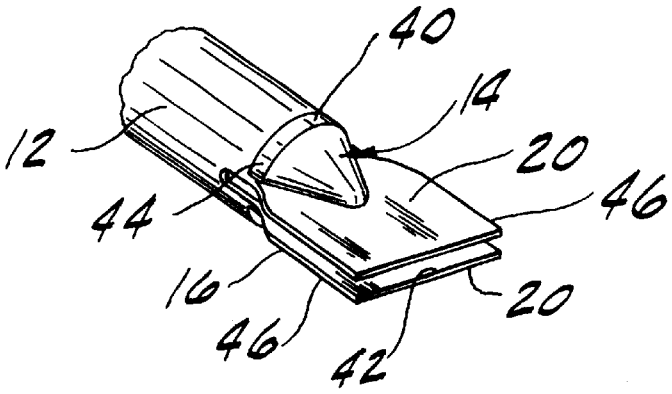
FIG. 6 shows the strut prior to machining flattened end portions of the tubular member.

After the platen 30 is inserted into the slots 16, the end portions 14 of the tubular member 22 are inserted into a die, generally indicated at 34, and radially compressed against opposite faces of the platen 30 to form the two generally parallel plates 20 (FIGS. 5 and 6). The die 34 comprises an upper and lower forming block 36 having deformations (not shown) corresponding to the final shape of the end portions 14, as is well known by those skilled in the art. The slots 16 are located where bend lines would normally be formed when a tubular member is flattened. The slots 16 eliminate bend lines which are present in conventional struts, thus preventing the formation of possible crack-propagating stresses in the strut. It is common in conventional struts for tears to form in the bend lines and propagate along the length of the tubular member. By eliminating these high stress areas, the tubular member 22 may be sized to have a smaller wall thickness, thus reducing the weight of the strut 10. The end portions 14 are not fully inserted into the die 34 so that the slots 16 extend beyond the plates 20 into the tubular portion 12 of the strut 10 to prevent the formation of high stress concentrations at an interface 40 of the end portions 14 and the tubular portion.

The plates 20 project endwise from the tubular portion 12 and are spaced apart a distance generally equal to the thickness of the platen 30 to form a gap 42 between the plates. This gap 42 provides for better stress distribution between the two spaced apart plates 20 than would be achieved by two contiguous plates. The use of two plates 20 distributes the shear stress load on a fastener (not shown) connecting the strut 10 to structure and cuts the load transmitted to the fastener by each plate in half, thus increasing the life of the fastener. A chamfered transitional section 44 is formed between each plate 20 and the tubular portion 12 to provide a smooth, load carrying transition area from the tubular portion to the plates. The transitional section 44 may have a length of 1.13 inches (2.87 cm), for example.

The plates 20 are machined to remove end margins 46 which extend beyond the diameter of the tubular portion 12 so that the plates have widths approximately equal to the diameter of the tubular portion (FIGS. 1 and 6). Aligned holes 50 are drilled or punched, for example, into the plates 20 for receiving a fastener (not shown) for connecting the strut 10 to adjacent structure. It is to be understood that the plates 20 may be machined to have shapes other than those shown and that the holes 50 may vary in size or location without departing from the scope of the invention. The gap 42 between the plates 20 and the configuration of the plates may also be different than shown and described herein. The strut 10 may also be coated with a corrosion resistant coating after machining of the strut 10 is completed.

If it is desired to have plates 20 having a thickness greater than the wall thickness of the tubular portion 12, the tubular portion may be machined or chemmilled after formation of the strut 10 to reduce the outer diameter of the tubular portion while leaving the plates at the thickness of the wall of the original tubular member 22 (FIGS. 1 and 2). This method may be used to reduce the overall weight of the strut 10 without impacting the load carrying capability of the end portions 14. In addition, tubing having end portions 14 which have thicker walls than the tubular portion 12 (also known as butted tubing) may be used.

It will be observed from the foregoing that the strut 10 of this invention has numerous advantages. Importantly, the slots 16 eliminate high stress areas in the strut 10 which are normally present with flattened tubes. This allows the strut 10 to be used in high stress applications. Furthermore, the strut 10 is integrally formed as one piece, thus eliminating expensive end fittings and manufacturing time required to attach the end fittings to the tubular portion 12. The gap 42 between the plates 20 evenly distributes the load between the two plates and puts a fastener joining the strut 10 to structure in double shear which cuts the fastener shear stresses in half. The strut 10 is economical to manufacture, lightweight and reliable.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A method of forming a structural member from a tubular member having a hollow interior, the method comprising the steps of:

(a) cutting a pair of slots in the tubular member extending from a free end of the tubular member and generally longitudinally with respect thereto, the slots being located generally opposite one another and each having a length and a width and their closed ends radiused, (b) inserting a platen edgewise into the slots so that the platen extends across the hollow interior of the tubular member from one slot to the other slot, the platen having a thickness less than the width of the slots;

(c) radially compressing opposing end portions of the tubular member against opposite faces of the platen to form two generally parallel plates projecting endwise from the tubular member, the plates being spaced apart a distance generally equal to the thickness of the platen and wherein the slots extend longitudinally beyond the plates into a tubular portion of the structural member, and (d) forming a chamfered transitional section between each plate and the tubular portion of the structural member at a location where the slot extends beyond the transitional section into the tubular portion of the structural member.

2. A method of forming a structural member as set forth in claim 1 wherein the step of compressing the end portions comprises inserting the end portions and platen into a die and closing the die to form the plates.

3. A method of forming a structural member as set forth in claim 1 further comprising machining edge margins of the plates such that the plates have widths approximately equal to the diameter of the tubular member.

4. A method of forming a structural member as set forth in claim 1 further comprising machining aligned holes in the plates.

5. A method of forming a structural member as set forth in claim 1 wherein the slots are formed by milling.

6. A method of forming a structural member as set forth in claim 1 wherein the step of machining the slots includes machining radii in the tubular member at closed ends of the slots.

7. A method of forming a structural member as set forth in claim 1 wherein the slots are diametrically opposite one another in a central longitudinal plane of the tubular member.

8. A method of forming a structural member as set forth in claim 1 further comprising machining a tubular portion of the structural member to reduce the outer diameter of the tubular portion.

9. A strut manufactured from a tubular member having a hollow interior, the strut comprising:

a tubular portion with opposite ends and an inside dimension across the hollow interior;

a pair of opposing end portions projecting endwise from an end of the tubular portion of the strut, the opposing end portions being integral with the tubular portion and flattened to form a pair of generally parallel plates spaced apart a distance less than the inside dimension of the tubular portion of the strut, the end portions of the strut being capable of carrying loads transmitted therethrough from the tubular portion of the strut;

a pair of slots defined in part by adjacent sides of the two plates, the slots extending longitudinally beyond the parallel plates into the tubular portion of the strut at locations generally opposite one another and having their closed ends radiused; and a chamfered transitional section between each plate and the tubular portion at a location were the slot extends beyond the transitional section into the tubular portion of the strut.

10. A strut as set forth in claim 9 wherein the plates are generally parallel to each other and to a central longitudinal plane of the tubular portion.

11. A strut as set forth in claim 9 wherein the slots are diametrically opposite one another in a central longitudinal plane of the tubular portion.

12. A strut as set forth in claim 9 wherein the slots have curved ends formed in the tubular portion.

13. A strut as set forth in claim 9 wherein the plates have a width approximately equal to the diameter of the tubular portion.

14. A strut as set forth in claim 9 wherein each plate has aligned holes formed therein.

15. A strut as set forth in claim 9 wherein the tubular portion has a wall thickness less than the thickness of each plate.

16. A strut as set forth in claim 9 further comprising a second pair of end portions extending from a second free end of the strut opposite a first free end of the strut.

* * * * *